US011257442B2

(12) United States Patent
Hu et al.

(10) Patent No.: US 11,257,442 B2
(45) Date of Patent: Feb. 22, 2022

(54) CONTROL CIRCUIT, LIGHT SOURCE DRIVING DEVICE AND DISPLAY APPARATUS

(71) Applicants: FUZHOU BOE OPTOELECTRONICS TECHNOLOGY CO., LTD., Fujian (CN); BOE TECHNOLOGY GROUP CO., LTD., Beijing (CN)

(72) Inventors: Ye Hu, Beijing (CN); Xiaoying Lu, Beijing (CN)

(73) Assignees: FUZHOU BOE OPTOELECTRONICS TECHNOLOGY CO., LTD., Fujian (CN); BOE TECHNOLOGY GROUP CO., LTD., Beijing (CN)

( * ) Notice: Subject to any disclaimer, the term of this patent is extended or adjusted under 35 U.S.C. 154(b) by 216 days.

(21) Appl. No.: 16/606,521

(22) PCT Filed: Jan. 4, 2019

(86) PCT No.: PCT/CN2019/070463
§ 371 (c)(1),
(2) Date: Oct. 18, 2019

(87) PCT Pub. No.: WO2019/161714
PCT Pub. Date: Aug. 29, 2019

(65) Prior Publication Data

US 2021/0287617 A1 Sep. 16, 2021

(30) Foreign Application Priority Data

Feb. 23, 2018 (CN) ..... 201810155293.9

(51) Int. Cl.
*G09G 3/34* (2006.01)
*G09G 3/36* (2006.01)
*G09G 5/10* (2006.01)

(52) U.S. Cl.
CPC ..... *G09G 3/3426* (2013.01); *G09G 3/3696* (2013.01); *G09G 5/10* (2013.01); *G09G 2320/041* (2013.01); *G09G 2320/064* (2013.01)

(58) Field of Classification Search
CPC .. G09G 3/34; G09G 3/36; G09G 5/00; G09G 5/10; G09G 3/3426; G09G 3/3696; G09G 2320/041; G09G 2320/064
See application file for complete search history.

(56) References Cited

U.S. PATENT DOCUMENTS 7,728,401 B2 6/2010 Takatori
2009/0201956 A1 8/2009 Kanesaka
(Continued)

FOREIGN PATENT DOCUMENTS

CN 1747172 A 3/2006
CN 101505559 A 8/2009
(Continued)

OTHER PUBLICATIONS

First Office Action dated May 7, 2020, for corresponding Chinese application 201810155293.9.

*Primary Examiner* — Chanh D Nguyen
*Assistant Examiner* — Nguyen H Truong
(74) *Attorney, Agent, or Firm* — Nath, Goldberg & Meyer; Joshua B. Goldberg

(57) ABSTRACT

The present disclosure provides a control circuit, a light source driving device and a display apparatus. The control
(Continued)

circuit comprises a current source circuit configured to generate a current signal having a magnitude positively correlated with a temperature of a region where the control circuit is located; a conversion circuit coupled to the current source circuit and configured to convert the current signal generated by the current source circuit into a voltage signal; and a first comparison circuit coupled to the conversion circuit and configured to output a control signal for controlling brightness of a light source according to the voltage signal received from the conversion circuit, a magnitude of the control signal being negatively correlated with the temperature of the region where the control circuit is located, and the brightness of the light source being positively correlated with the magnitude of the control signal.

17 Claims, 2 Drawing Sheets

(56) References Cited

U.S. PATENT DOCUMENTS

| | | | | |
|---|---|---|---|---|
| 2013/0128405 | A1* | 5/2013 | Lee | H02H 5/04 361/91.1 |
| 2013/0162144 | A1 | 6/2013 | Lee et al. | |
| 2015/0221258 | A1 | 8/2015 | Xu | |
| 2015/0261233 | A1* | 9/2015 | Duan | G09G 3/3655 345/101 |
| 2016/0117999 | A1* | 4/2016 | Hayashi | G09G 3/3406 345/691 |

FOREIGN PATENT DOCUMENTS

| | | | |
|---|---|---|---|
| CN | 101527988 | A | 9/2009 |
| CN | 103179745 | A | 6/2013 |
| CN | 103606352 | A | 2/2014 |
| CN | 104376816 | A | 2/2015 |
| CN | 205140491 | U | 4/2016 |
| JP | 2006031977 | A | 2/2006 |

* cited by examiner

CONTROL CIRCUIT, LIGHT SOURCE DRIVING DEVICE AND DISPLAY APPARATUS

CROSS-REFERENCE TO RELATED APPLICATION

This is a National Phase Application filed under 35 U.S.C. 371 as a national stage of PCT/CN2019/070463, filed on Jan. 4, 2019, an application claiming priority to Chinese Patent Application No. 201810155293.9, filed on Feb. 23, 2018, the contents of which are incorporated by reference in the entirety.

TECHNICAL FIELD

The present disclosure relates to the field of display technology, more particularly, to a control circuit, a light source driving device and a display apparatus.

BACKGROUND

In a liquid crystal display apparatus, a driving circuit and a backlight source may generate a large amount of heat during operation, resulting in increased temperature of the liquid crystal display apparatus. When the temperature is high enough to reach a certain high level, a liquid crystal display panel or the driving circuit may operate abnormally or even be burned.

SUMMARY

In an aspect, the present disclosure provides a control circuit including:

a current source circuit configured to generate a current signal having a magnitude positively correlated with a temperature of a region where the control circuit is located;

a conversion circuit coupled to the current source circuit and configured to convert the current signal generated by the current source circuit into a voltage signal; and a first comparison circuit coupled to the conversion circuit and configured to output a control signal for controlling brightness of a light source according to the voltage signal received from the conversion circuit, a magnitude of the control signal being negatively correlated with the temperature of the region where the control circuit is located, and the brightness of the light source being positively correlated with the magnitude of the control signal.

In an embodiment, the first comparison circuit includes a first input terminal and a second input terminal, and at least one of the first input terminal and the second input terminal is coupled to the conversion circuit and configured to receive the voltage signal from the conversion circuit, and the first comparison circuit is configured to output the control signal in response to a magnitude of a voltage signal input to the first input terminal being greater than a magnitude of a voltage signal input to the second input terminal, the magnitude of the control signal being negatively correlated with a different between the voltage signals input to the first input terminal and the second input terminal of the first comparison circuit.

In an embodiment, the conversion circuit includes a first conversion sub-circuit coupled to the first input terminal of the first comparison circuit and configured to provide a first voltage signal to the first input terminal of the first comparison circuit, a magnitude of the first voltage signal being positively correlated with a magnitude of the current signal generated by the current source circuit.

In an embodiment, the conversion circuit includes a second conversion sub-circuit coupled to the second input terminal of the first comparison circuit and configured to provide a second voltage signal to the second input terminal of the first comparison circuit, a magnitude of the second voltage signal being negatively correlated with the magnitude of the current signal generated by the current source circuit.

In an embodiment, the control circuit further includes a second comparison circuit configured to output a turn-off signal for controlling a display apparatus having the control circuit to be turned off in response to a magnitude of a voltage signal input to a first input terminal thereof being greater than a magnitude of a voltage signal input to a second input terminal thereof, and the first conversion sub-circuit is further coupled to the first input terminal of the second comparison circuit, and is configured to generate a third voltage signal having a magnitude positively correlated with the magnitude of the current signal generated by the current source circuit and output the third voltage signal to the first input terminal of the second comparison circuit; the magnitude of the third voltage signal smaller lower than the magnitude of the first voltage signal.

In an embodiment, the second conversion sub-circuit is further coupled to the second input terminal of the second comparison circuit and configured to output the second voltage signal to the second input terminal of the second comparison circuit.

In an embodiment, the current source circuit includes a current generation circuit configured to generate a bias current signal having a magnitude positively correlated with the temperature of the region where the control circuit is located;

the current source circuit further includes a first replica circuit coupled to the current generation circuit and the first conversion sub-circuit, and configured to supply a first mirror current signal having a same magnitude as the magnitude of the bias current signal and output the first mirror current signal to the first conversion sub-circuit; and the first conversion sub-circuit is configured to convert the first mirror current signal into the first voltage signal.

In an embodiment, the current source circuit further includes a second replica circuit coupled to the current generation circuit and the second conversion sub-circuit, and configured to supply a second mirror current signal having a same magnitude as the magnitude of the bias current signal and output the second mirror current signal to the second conversion sub-circuit; and the second conversion sub-circuit is configured to convert the second mirror current signal into the second voltage signal.

In an embodiment, the current generation circuit includes a first triode, a second triode, a first resistor, a second resistor, a third resistor, a first P-type field effect transistor, a second P-type field effect transistor, a third P-type field effect transistor, a fourth P-type field effect transistor, a first N-type field effect transistor, a second N-type field effect transistor, a third N-type field effect transistor, and a fourth N-type field effect transistor; wherein width-to-length ratios of the first to fourth N-type field effect transistors are the same, and width-to-length ratios of the first to fourth P-type field effect transistors are the same, a gate electrode of the first P-type field effect transistor is coupled to a second electrode of the second P-type field effect transistor, a first electrode of the first P-type field effect transistor is coupled to a power supply terminal, and a second electrode of the first P-type field effect transistor is coupled to a first electrode of the second P-type field effect transistor;

a gate electrode of the third P-type field effect transistor is coupled to the gate electrode of the first P-type field effect transistor, a first electrode of the third P-type field effect transistor is coupled to the power supply terminal, and a second electrode of the third P-type field effect transistor is coupled to a first electrode of the fourth P-type field effect transistor:

a gate electrode of the fourth P-type field effect transistor is coupled to a gate electrode of the second P-type field effect transistor and a first electrode of the third N-type field effect transistor, and a second electrode of the fourth P-type field effect transistor is coupled to a gate electrode of the third N-type field effect transistor and a gate electrode of the fourth N-type field effect transistor;

a gate electrode of the first N-type field effect transistor is coupled to a gate electrode of the second N-type field effect transistor and a first electrode of the fourth N-type field effect transistor, and a first electrode of the first N-type field effect transistor is coupled to a second electrode of the third N-type field effect transistor;

a first electrode of the second N-type field effect transistor is coupled to a second electrode of the fourth N-type field effect transistor;

a first terminal of the first resistor is coupled to a second electrode of the first N-type field effect transistor, a second terminal of the first resistor is coupled to an emitter of the first triode, an emitter of the second triode is coupled to a second electrode of the second N-type field effect transistor, and a base and a collector of the first triode and a base and a collector of the second triode are all coupled to a low level signal terminal;

a first terminal of the second resistor is coupled to the second electrode of the second P-type field effect transistor, and a second terminal of the second resistor is coupled to the first electrode of the third N-type field effect transistor; and a first terminal of the third resistor is coupled to the second electrode of the fourth P-type field effect transistor, and a second terminal of the third resistor is coupled to the first electrode of the fourth N-type field effect transistor.

In an embodiment, the first replica circuit includes a fifth P-type field effect transistor, a gate electrode of the fifth P-type field effect transistor is coupled to the gate electrode of the first P-type field effect transistor, a first electrode of the fifth P-type field effect transistor is coupled to the power supply terminal, and a second electrode of the fifth P-type field effect transistor is coupled to the first conversion sub-circuit; and a width-to-length ratio of the fifth P-type field effect transistor is equal to the width-to-length ratio of the first P-type field effect transistor.

In an embodiment, the second replica circuit includes a sixth P-type field effect transistor, a gate electrode of the sixth P-type field effect transistor is coupled to the gate electrode of the first P-type field effect transistor, a first electrode of the sixth P-type field effect transistor is coupled to the power supply terminal, and a second electrode of the sixth P-type field effect transistor is coupled to the second conversion sub-circuit; and a width-to-length ratio of the sixth P-type field effect transistor is equal to the width-to-length ratio of the first P-type field effect transistor.

In an embodiment, the first comparison circuit includes:

a transconductance amplifier having a non-inverting input terminal coupled to the first input terminal of the first comparison circuit, an inverting input terminal coupled to the second input terminal of the first comparison circuit and an output terminal coupled to an output terminal of the first comparison circuit; a positive power supply terminal of the transconductance amplifier is coupled to the current source circuit, and a negative power supply terminal of the transconductance amplifier is coupled to the low level signal terminal;

a sixth resistor having a first terminal coupled to the output terminal of the first comparison circuit and a second terminal coupled to the low level signal terminal; and a seventh resistor having a first terminal coupled to the power supply terminal, and a second terminal coupled to the output terminal of the first comparison circuit.

In an embodiment, the current source circuit further includes a seventh P-type field effect transistor, a gate electrode of the seventh P-type field effect transistor is coupled to the gate electrode of the first P-type field effect transistor, a first electrode of the seventh P-type field effect transistor is coupled to the power supply terminal, and a second electrode of the seventh P-type field effect transistor is coupled to the positive power supply terminal of the transconductance amplifier.

In an embodiment, the first conversion sub-circuit includes a resistor branch, the resistor branch includes at least one resistor, a first terminal of the resistor branch is coupled to the second electrode of the fifth P-type field effect transistor, a second terminal of the resistor branch is coupled to the low level signal terminal, and the first input terminal of the first comparison circuit is coupled to the first terminal of the resistor branch.

In an embodiment, the second conversion sub-circuit includes a third triode, a base and a collector of the third triode are coupled to the low level signal terminal, and an emitter of the third triode is coupled to the second input terminal of the first comparison circuit and the second electrode of the sixth P-type field effect transistor.

In an embodiment, the first conversion sub-circuit includes a fourth resistor and a fifth resistor, a first terminal of the fourth resistor is coupled to a first terminal of the fifth resistor, a second terminal of the fourth resistor is coupled to the low level signal terminal, and a second terminal of the fifth resistor is coupled to the second electrode of the fifth P-type field effect transistor; the first input terminal of the second comparison circuit is coupled to the first terminal of the fourth resistor, and the second input terminal of the second comparison circuit is coupled to the emitter of the third triode.

In an embodiment, the second comparison circuit includes a voltage comparator, a non-inverting input terminal of the voltage comparator is coupled to the first input terminal of the second comparison circuit, an inverting input terminal of the voltage comparator is coupled to the second input terminal of the second comparison circuit, and an output terminal of the voltage comparator is coupled to the output terminal of the second comparison circuit.

In an embodiment, the current source circuit further includes an eighth P-type field effect transistor, a gate electrode of the eighth P-type field effect transistor is coupled to the gate electrode of the first P-type field effect transistor, a first electrode of the eighth P-type field effect transistor is coupled to the power supply terminal, a second electrode of the eighth P-type field effect transistor is coupled to a positive power supply terminal of the voltage comparator, and a negative power supply terminal of the voltage comparator is coupled to the low level signal terminal.

Correspondingly, the present disclosure further provides a light source driving device including the above control circuit and a light source driving circuit coupled to the control circuit, wherein the light source driving circuit is configured to adjust brightness of a light source according to the control signal output by the control circuit such that the adjusted brightness of the light source is positively correlated with the magnitude of the control signal.

In an embodiment, the light source driving circuit includes:

a pulse generator coupled to the control circuit and configured to generate a pulse modulation signal according to the control signal output by the control circuit, a duty cycle of the pulse modulation signal being positively correlated with the magnitude of the control signal;

a power source configured to provide a current to a light-emitting element of the light source:

a switch element coupled to the pulse generator, the power source, and the light-emitting element, and configured to control connection and disconnection between the power source and the light-emitting element according to the pulse modulation signal from the pulse generator to control an average current of the light-emitting element.

Correspondingly, the present disclosure further provides a display apparatus including a display module and the above light source driving device, the display module includes a backlight coupled to the light source driving device, and the light source driving device is configured to adjust brightness of the backlight.

In an embodiment, the display apparatus further includes a gating switch, the control circuit includes a second comparison circuit, the second comparison circuit is configured to output a turn off signal for controlling the display apparatus to be turned off according to the voltage signal received from the conversion circuit, the gating switch is coupled between the display module and a power supply terminal for supplying power to the display module, a control terminal of the gating switch is coupled to the second comparison circuit of the control circuit, and the gating switch is configured to disconnect the power supply terminal from the display module upon receipt of the turn-off signal from the second comparison circuit of the control circuit.

BRIEF DESCRIPTION OF THE DRAWINGS

The drawings, which constitute part of the specification, are intended to provide a further understanding of the present disclosure, and explain the present disclosure together with specific implementations, rather than limiting the present disclosure. In the drawings.

DETAILED DESCRIPTION

The specific implementations of the present disclosure will be described in detail below with reference to the accompanying drawings. It is to be understood that the specific implementations described herein are merely used for describing and explaining the present disclosure, and are not intended to limit the present disclosure.

Figure 1:
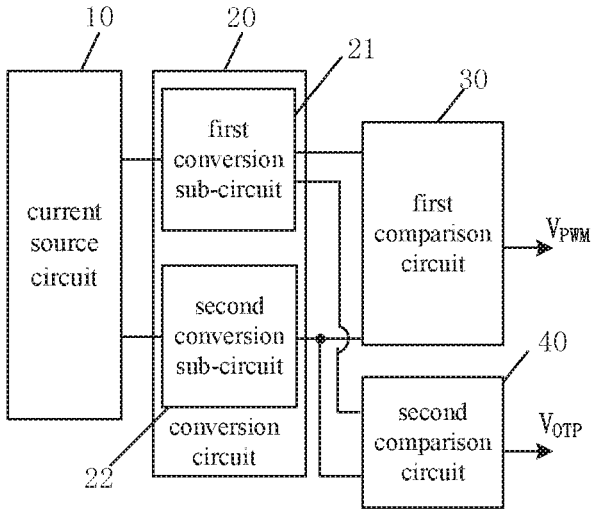
FIG. 1 is a block diagram of a control circuit according to an embodiment of the present disclosure.

As an aspect of the present disclosure, a control circuit is provided. As shown in FIG. 1, the control circuit includes a current source circuit 10, a conversion circuit 20, and a first comparison circuit 30. The current source circuit 10 is configured to generate a current signal whose magnitude is positively correlated with a temperature of a region in which the control circuit is located. The conversion circuit 20 is coupled to the current source circuit 10 and is configured to convert the current signal generated by the current source circuit 10 into a voltage signal. The first comparison circuit 30 is coupled to the conversion circuit 20 and configured to output a control signal for controlling brightness of a light source according to the voltage signal received from the conversion circuit 20. A magnitude of the control signal is negatively correlated with the temperature of the region in which the control circuit is located, and the brightness of the light source is positively correlated with the magnitude of the control signal.

In some embodiments, the current source circuit 10 is coupled to a power supply terminal VDD.

In some embodiments, the first comparison circuit 30 includes a first input terminal and a second input terminal, and at least one of the first input terminal and the second input terminal is coupled to the conversion circuit 20 and configured to receive the voltage signal from the conversion circuit 20.

In some embodiments, the conversion circuit 20 includes a first conversion sub-circuit 21 and/or a second conversion sub-circuit 22. The first conversion sub-circuit 21 is coupled to the first input terminal of the first comparison circuit 30, and configured to provide a first voltage signal to the first input terminal of the first comparison circuit 30, and a magnitude of the first voltage signal is positively correlated with a magnitude of the current signal generated by the current source circuit 10. The second conversion sub-circuit 22 is coupled to the second input terminal of the first comparison circuit 30 and configured to provide a second voltage signal to the second input terminal of the first comparison circuit 30, and a magnitude of the second voltage signal is negatively correlated with the magnitude of the current signal generated by the current source circuit 10.

In some embodiments, the first comparison circuit 30 is configured to output a control signal, which, for example, may be a voltage signal $V_{PWM}$, when a voltage signal input to its first input terminal is higher than a voltage signal input to its second input terminal. The magnitude of the control signal $V_{PWM}$ is negatively correlated with a difference between the voltage signals of the first input terminal and the second input terminal of the first comparison circuit 30. In an embodiment, the control signal $V_{PWM}$, is used for controlling brightness of a light source such that the brightness of the light source is positively correlated with the magnitude of the control signal $V_{PWM}$. In an embodiment, the light source is a backlight in a display apparatus It should be noted that in a case where the conversion circuit 20 includes the first conversion sub-circuit 21 but excludes the second conversion sub-circuit 22, the second input terminal of the first comparison circuit 30 may be coupled to a first reference voltage terminal for providing a first reference voltage; in a case where the conversion circuit 20 includes the second conversion sub-circuit 22 but excludes the first conversion sub-circuit 21, the first input terminal of the first comparison circuit 30 may be coupled to a second reference voltage terminal for providing a second reference voltage. Magnitudes of the first reference voltage and the second reference voltage may be set as practically required such that the voltage signal of the second input terminal of the first comparison circuit 30 is greater than the voltage signal of the first input terminal of the first comparison circuit 30 when the temperature of the region where the control circuit is located is within a normal range (e.g., lower than 60° C.).

The control circuit in the present disclosure may be applied in a display apparatus having a backlight. When the temperature of the region where the control circuit is located increases, the current generated by the current source circuit 10 increases, and at this time, the voltage signal provided to the first input terminal of the first comparison circuit 30 increases (and/or the voltage signal of the second input terminal of the first comparison circuit 30 decreases), so that the control signal output by the first comparison circuit 30 decreases, which can in turn reduce the brightness of the backlight to reduce the temperature of the display apparatus.

Figure 2:
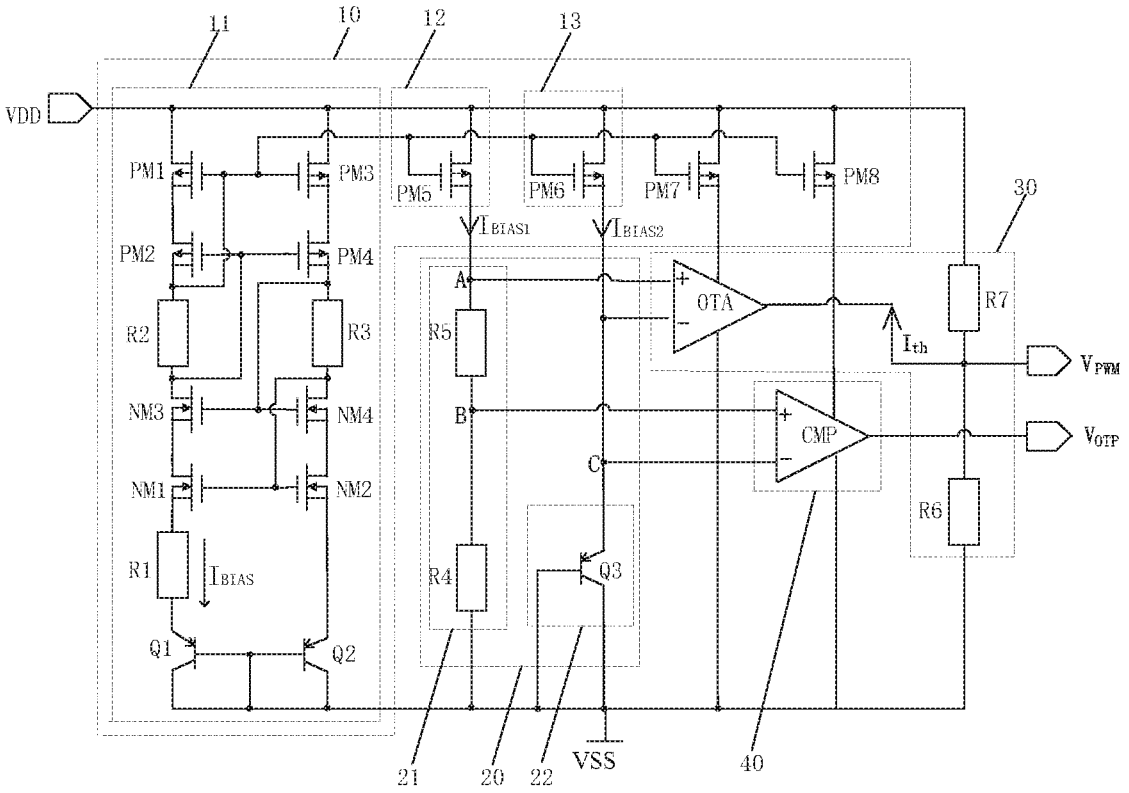
FIG. 2 is a schematic structural diagram of a control circuit according to an embodiment of the present disclosure.

In some embodiments, as shown in FIG. 2, the current source circuit 10 includes a current generation circuit 11, and in a case where the conversion circuit 20 includes the first conversion sub-circuit 21, the current source circuit 10 further includes a first replica circuit 12. In a case where the conversion circuit 20 includes the second conversion sub-circuit 22, the current source circuit 10 further includes a second replica circuit 13. In an embodiment, the current generation circuit 11 is coupled between the power supply terminal VDD and a low level signal terminal VSS and configured to generate a bias current signal having a magnitude positively correlated with the temperature of the region in which the control circuit is located. The first replica circuit 12 is coupled to the current generation circuit 11 and the first conversion sub-circuit 21, and is configured to replicate the bias current signal to generate a first mirror current signal $I_{BIAS1}$ whose magnitude is equal to the magnitude of the bias current signal, and output the first mirror current signal to the first conversion sub-circuit 21; the first conversion sub-circuit 21 is configured to convert the first mirror current signal into the first voltage signal. The second replica circuit 13 is coupled to the current generation circuit 11 and the second conversion sub-circuit 22, and configured to replicate the bias current signal to generate a second mirror current signal $I_{BIAS2}$ whose magnitude is equal to the magnitude of the bias current signal, and output the second mirror current signal to the second conversion sub-circuit 22; the second conversion sub-circuit 22 is configured to convert the second mirror current signal into the second voltage signal. With current replication by the first replica circuit 12 and the second replica circuit 13, the first conversion sub-circuit 21 and the second conversion sub-circuit 22 can accurately receive the current signal positively correlated with the temperature.

The control circuit of the present disclosure will be described in detail below with reference to FIGS. 1 and 2. In the following example, the conversion circuit 20 includes both the first conversion sub-circuit 21 and the second conversion sub-circuit 22, and the current source circuit 10 includes the current generation circuit 11, the first replica circuit 12, and the second replica circuit 13.

In some embodiments, the current generation circuit 11 may be a Wilson current mirror, which includes a first triode Q1, a second triode Q2, a first resistor R1, a first P-type field effect transistor PM1, a second P-type field effect transistor PM2, a third P-type field effect transistor PM3, a fourth P-type field effect transistor PM4, a first N-type field effect transistor NM1, a second N-type field effect transistor NM2, a third N-type field effect transistor NM3, and a fourth N-type field effect transistor NM4. The first P-type field effect transistor PM1, the second P-type field effect transistor PM2, the third P-type field effect transistor PM3, and the fourth P-type field effect transistor PM4 have a same width-to-length ratio, and the first N-type field effect transistor NM1, the second N-type field effect transistor NM2, the third N-type field effect transistor NM3, and the fourth N-type field effect transistor NM4 have a same width-to-length ratio.

A gate electrode of the first P-type field effect transistor PM1 is coupled to a second electrode of the second P-type field effect transistor PM2, a first electrode of the first P-type field effect transistor PM1 is coupled to the power supply terminal VDD, and a second electrode of the first P-type field effect transistor PM1 is coupled to a first electrode of the second P-type field effect transistor PM2.

A gate electrode of the third P-type field effect transistor PM3 is coupled to the gate electrode of the first P-type field effect transistor PM1, a first electrode of the third P-type field effect transistor PM3 is coupled to the power supply terminal VDD, and a second electrode of the third P-type field effect transistor PM3 is coupled to a first electrode of the fourth P-type field effect transistor PM4.

A gate electrode of the fourth P-type field effect transistor PM4 is coupled to a gate electrode of the second P-type field effect transistor PM2 and a first electrode of the third N-type field effect transistor NM3, and a second electrode of the fourth P-type field effect transistor PM4 is coupled to a gate electrode of the third N-type field effect transistor NM3 and a gate electrode of the fourth N-type field effect transistor NM4.

A gate electrode of the first N-type field effect transistor NM1 is coupled to a gate electrode of the second N-type field effect transistor NM2 and a first electrode of the fourth N-type field effect transistor NM4, and a first electrode of the first N-type field effect transistor NM1 is coupled to a second electrode of the third N-type field effect transistor NM3.

A first electrode of the second N-type field effect transistor NM2 is coupled to a second electrode of the fourth N-type field effect transistor NM4. It could be understood that the P-type field effect transistors and the N-type field effect transistors each operate in a saturation state.

Two terminals of the first resistor R1 are coupled to a second electrode of the first N-type field effect transistor NM1 and an emitter of the first triode Q1, respectively, and an emitter of the second triode Q2 is coupled to a second electrode of the second N-type field effect transistor NM2, and a base and a collector of the first triode Q1 and a base and a collector of the second triode Q2 are all coupled to the low level signal terminal VSS.

In the current generation circuit 11, the width-to-length ratios of the four P-type field effect transistors are the same, the width-to-length ratios of the four N-type field effect transistors are the same, the gate electrode of the first P-type field effect transistor PM1 is coupled to the gate electrode of the third P-type field effect transistor PM3, the gate electrode of the second P-type field effect transistor PM2 is coupled to the gate electrode of the fourth P-type field effect transistor PM4, the gate electrode of the first N-type field effect transistor NM1 is coupled to the gate electrode of the second N-type field effect transistor NM2, and the gate electrode of the third N-type field effect transistor NM3 is coupled to the gate electrode of the fourth N-type field effect transistor NM4. Therefore, currents respectively flowing through the first triode Q1 and the second triode Q2 have an equal magnitude, and a potential of the second electrode of the first N-type field effect transistor NM1 is equal to a potential of the second electrode of the second N-type field effect transistor NM2. Thus, the magnitude of the bias current signal $I_{BIAS}$ (i.e., the magnitude of the currents respectively flowing through the first triode Q1 and the second triode Q2) generated by the current generation circuit 11 is:

$$I_{BIAS} = \frac{V_{BE2} - V_{BE1}}{R_1} = \frac{V_T - \ln n}{R_1}$$

where $V_T$ is a thermoelectric potential, which is positively correlated with an absolute temperature; R1 is a resistance of the first resistor R1; $n=A_2/A_1$, $A_1$ is a junction area of the first triode Q1, and A2 is a junction area of the second triode Q2; $V_{BE1}$ and $V_{BE2}$ are base-emitter voltages of the first triode Q1 and the second triode Q2, respectively. It can be seen that the bias current signal is positively correlated with the temperature, and a desired proportional coefficient can be obtained by appropriately selecting a value of the resistance of the first resistor R1.

Further, as shown in FIG. 2, the current generation circuit 11 further includes a second resistor R2 and a third resistor R3. Two terminals of the second resistor R2 are coupled to the second electrode of the second P-type field effect transistor PM2 and the first electrode of the third N-type field effect transistor NM3, respectively. Two terminals of the third resistor R3 are coupled to the second electrode of the fourth P-type field effect transistor PM4 and the first electrode of the fourth N-type field effect transistor NM4, respectively, so that potentials of the second terminals of the second and third resistors R2 and R3 change as potentials of the first terminals of the second and third resistors R2 and R3 change due to external interference, so as to ensure that a first terminal of the first resistor R1 and the emitter of the second triode Q2 maintain a same potential, thereby increasing the sensitivity of the current generation circuit 11.

In some embodiments, as shown in FIG. 2, the first replica circuit 12 may include a fifth P-type field effect transistor PM5. A gate electrode of the fifth P-type field effect transistor PM5 is coupled to the gate electrode of the first P-type field effect transistor PM1, a first electrode of the fifth P-type field effect transistor PM5 is coupled to the power supply terminal VDD, and a second electrode of the fifth P-type field effect transistor PM5 is coupled to the first conversion sub-circuit 21. A width-to-length ratio of the fifth P-type field effect transistor PM5 is the same as the width-to-length ratio of the first P-type field effect transistor PM1, so that the fifth P-type field effect transistor PM5 and the first P-type field effect transistor PM1 form a current mirror. Thereby, the fifth P-type field effect transistor PM5 supplies the first conversion sub-circuit 21 with a current signal having the same magnitude as the bias current signal, i.e., a first mirror current signal $I_{BIAS1}$.

In some embodiments, as shown in FIG. 2, the second replica circuit 13 includes a sixth P-type field effect transistor PM6. A gate electrode of the sixth P-type field effect transistor PM6 is coupled to the gate electrode of the first P-type field effect transistor PM1, a first electrode of the sixth P-type field effect transistor PM6 is coupled to the power supply terminal VDD, and a second electrode of the sixth P-type field effect transistor PM6 is coupled to the second conversion sub-circuit 22. A width-to-length ratio of the sixth P-type field effect transistor PM6 is the same as the width-to-length ratio of the first P-type field effect transistor PM1, so that the sixth P-type field effect transistor PM6 and the first P-type field effect transistor PM1 form a current mirror. Thereby, the sixth P-type field effect transistor PM6 supplies the second conversion sub-circuit 22 with a current signal having the same magnitude as the bias current signal, i.e., a second mirror current signal $I_{BIAS2}$.

In some embodiments, as shown in FIG. 2, the first comparison circuit 30 includes a transconductance amplifier OTA, a sixth resistor R6, and a seventh resistor R7. A non-inverting input terminal of the transconductance amplifier OTA is coupled to the first input terminal of the first comparison circuit 30, an inverting input terminal of the transconductance amplifier OTA is coupled to the second input terminal of the first comparison circuit 30, and an output terminal of the transconductance amplifier OTA is coupled to the output terminal of the first comparison circuit 30. A positive power supply terminal of the transconductance amplifier OTA is coupled to the current source circuit 10, and a negative supply terminal of the transconductance amplifier OTA is coupled to a low level signal terminal. Two terminals of the sixth resistor R6 are coupled to the output terminal of the first comparison circuit 30 and the low level signal terminal VSS, respectively. Two terminals of the seventh resistor R7 are coupled to the power supply terminal VDD and the output terminal of the first comparison circuit 30, respectively.

In order to provide an operating current to the transconductance amplifier OTA, as shown in FIG. 2, the current source circuit 10 further includes a seventh P-type field effect transistor PM7, a gate electrode of the seventh P-type field effect transistor PM7 is coupled to the gate electrode of the first P-type field effect transistor PM1, a first electrode of the seventh P-type field effect transistor PM7 is coupled to the power supply terminal VDD, and a second electrode of the seventh P-type field effect transistor PM7 is coupled to the positive power supply terminal of the transconductance amplifier OTA. The negative power supply terminal of the transconductance amplifier OTA is coupled to the low level signal terminal VSS.

When a voltage of the non-inverting input terminal of the transconductance amplifier OTA is lower than a voltage of the inverting input terminal of the transconductance amplifier OTA, the transconductance amplifier OTA does not generate a current, that is, $I_{th}=0$, and the sixth resistor R6 and the seventh resistor R7 are connected in series between the power supply terminal VDD and the low level signal terminal VSS, so that there is an initial current in a branch where the sixth resistor R6 and the seventh resistor R7 are located. When the voltage at the non-inverting input terminal of the transconductance amplifier OTA is higher than the voltage of the inverting input terminal of the transconductance amplifier OTA, a current $I_{th}$ is input to the output terminal of the transconductance amplifier OTA (as shown in FIG. 2). As the difference between the voltages of the non-inverting input terminal and the inverting input terminal increases, the current $I_{th}$ flowing into the output terminal of the transconductance amplifier OTA increases, the current flowing through the sixth resistor R6 decreases, and the voltage across the sixth resistor R6 decreases, so that the voltage signal $V_{PWM}$ output by the first comparison circuit 30 is lowered.

In some embodiments, the first conversion sub-circuit 21 includes a resistor branch including one resistor or a plurality of resistors connected in series. A first terminal of the resistor branch is coupled to the current source circuit 10, a second terminal of the resistor branch is coupled to the low level signal terminal, and the first input terminal of the first comparison circuit 30 is coupled to the first terminal of the resistor branch. After the current source circuit 10 supplies the first mirror current signal to the resistor branch, a voltage is generated across the resistor branch. In a case where the low level signal terminal VSS is grounded, a value of the voltage signal received by the non-inverting input terminal of the transconductance amplifier OTA is the product of the resistance value of the resistor branch and the first mirror current signal.

Further, as shown in FIG. 2, the first conversion sub-circuit 21 includes a fourth resistor R4 and a fifth resistor R5. A first terminal of the fourth resistor R4 is coupled to a first terminal of the fifth resistor R5, a second terminal of the fourth resistor R4 is coupled to the low level signal terminal VSS, and a second terminal of the fifth resistor R5 is coupled to the current source circuit 10.

Further, as shown in FIG. 2, the second conversion sub-circuit 22 includes a third triode Q3, a base and a collector of the third triode Q3 are both coupled to the low level signal terminal VSS, an emitter of the third triode Q3 is coupled to the second input terminal of the first comparison circuit 30 and the current source circuit 10, and a base-emitter voltage $V_{BE3}$ of the third triode Q3 is negatively correlated with the temperature.

In practical applications, resistance values of the first resistor R1, the fourth resistor R4, and the fifth resistor R5 may be set as required such that the potential of the second terminal of the fifth resistor R5 is lower than the potential of the emitter of the third triode Q3 when the temperature of the region where the control circuit is located is within a normal temperature range (e.g., lower than 60° C.), and the potential of the second terminal of the fifth resistor R5 is higher than the potential of the emitter of the third triode Q3 when the temperature of the region where the control circuit is located is higher than the normal temperature range.

Further, as shown in FIGS. 1 and 2, the control circuit further includes a second comparison circuit 40 having a first input terminal, a second input terminal, and an output terminal. The first conversion sub-circuit 21 is further configured to generate a third voltage signal positively correlated with the current signal generated by the current source circuit 10, and output the third voltage signal to the first input terminal of the second comparison circuit 40. The third voltage signal is lower than the first voltage signal under the same current signal. The second conversion sub-circuit 22 is further configured to output the second voltage signal to the second input terminal of the second comparison circuit 40. The second comparison circuit 40 is configured to output a turn-off signal for controlling a display apparatus including the control circuit to be turned off when the voltage signal of the first input terminal of the second comparison circuit 40 is higher than the voltage signal of the second input terminal of the second comparison circuit 40.

For example, when the temperature of the display apparatus reaches a first temperature (e.g., 60° C.), the first conversion sub-circuit 21 generates a first voltage signal and a third voltage signal, and the second conversion sub-circuit 22 generates a second voltage signal, the first voltage signal is higher than the second voltage signal, and the third voltage signal is lower than the second voltage signal. At this time, the first comparison circuit 30 outputs a control signal to control the brightness of the backlight. As the difference between the first voltage signal and the second voltage signal increases, the control signal decreases, so that the brightness of the backlight is lowered, thereby lowering the temperature of the display apparatus. When the temperature of the display apparatus reaches a second temperature (e.g., 80° C.), the first voltage signal and the third voltage signal generated by the first conversion sub-circuit 21 are both higher than the second voltage signal generated by the second conversion sub-circuit 22, so that the second comparison circuit 40 generates a turn-off signal to control the display apparatus to be turned off, thereby preventing the display apparatus from being burned due to excessively high temperature. It can be seen that the second comparison circuit 40 can achieve an over-temperature protection.

In some embodiments, the first input terminal of the second comparison circuit 40 is coupled to the first terminal of the fourth resistor R4. The second input terminal of the second comparison circuit 40 is coupled to the emitter of the third triode Q3. The second comparison circuit 40 may include a voltage comparator CMP, a non-inverting input terminal of the voltage comparator CMP is coupled to the first input terminal of the second comparison circuit 40, and an inverting input terminal of the voltage comparator CMP is coupled to the second input terminal of the second comparison circuit 40, and an output terminal of the voltage comparator CMP is coupled to the output terminal of the second comparison circuit 40. In addition, in order to supply an operating current to the voltage comparator CMP, as shown in FIG. 2, the current source circuit 10 may further include an eighth P-type field effect transistor PM8, a gate electrode of the eighth P-type field effect transistor PM8 is coupled to the gate electrode of the first P-type field effect transistor PM1, a first electrode of the eighth P-type field effect transistor PM8 is coupled to the power supply terminal, and a second electrode of the eighth P-type field effect transistor PM8 is coupled to a positive power supply terminal of the voltage comparator CMP. A negative power supply terminal of the voltage comparator CMP is coupled to the low level signal terminal VSS.

When the control circuit operates, the current generation circuit 11 generates a bias current signal $I_{BIAS}$ positively correlated with the temperature, the first replica circuit 12 supplies the first mirror current signal $I_{BIAS1}$ equal in magnitude to the bias current signal $I_{BIAS}$ to the fourth resistor R4 and the fifth resistor R5, and the second replica circuit 13 supplies the second mirror current signal $I_{BIAS2}$ equal in magnitude to the bias current signal to the third triode Q3. When the temperature of the display apparatus is within a normal range (for example, below 60° C.), the $I_{BIAS}$ is small, the voltage at point A (i.e., the second terminal of the fifth resistor R5) is lower than the voltage at point C (i.e., the emitter of the third triode Q3), and no current is input to the output terminal of the transconductance amplifier OTA, $I_{th}=0$. As the temperature increases, the bias current signal $I_{BIAS}$ gradually increases, and the base-emitter voltage of the third triode Q3 gradually decreases. When the temperature of the display apparatus rises to a first temperature (for example, 60° C.), the voltage at point A is higher than the voltage at point C, and a current flows into the transconductance amplifier OTA, $I_{th}>0$. That is, part of the current flowing in a branch in which the sixth resistor R6 and the seventh resistor R7 are located flows into the transconductance amplifier OTA, so that the voltage across the sixth resistor R6 is reduced, and the control voltage $V_{PWM}$ output by the first comparison circuit 30 is lowered. Moreover, as the temperature increases, $I_{th}$ increases, the control signal $V_{PWM}$ output by the first comparison circuit 30 decreases, so that the brightness of the backlight is controlled to be lowered, thereby lowering the temperature of the display apparatus. In a case where the temperature of the display apparatus cannot be further lowered through the control signal $V_{PWM}$, if the temperature of the display apparatus continues to rise to reach a second temperature (for example, 80° C.), the bias current signal $I_{BIAS}$ continues to rise, so that the voltage at point B (i.e., the first terminal of the fifth resistor) is also higher than the voltage at point C, and at this time, the second comparison circuit 40 outputs a turn-off signal $V_{OTP}$ to control the display apparatus to be turned off.

As another aspect of the present disclosure, a light source driving device including the above-described control circuit provided by the present disclosure and a light source driving circuit coupled to the control circuit, the light source driving circuit is configured to adjust, according to the control signal output by the control circuit, the brightness of the light source such that the adjusted brightness of the light source is positively correlated with the magnitude of the control signal. In an embodiment, the light source is a backlight.

Figure 3:
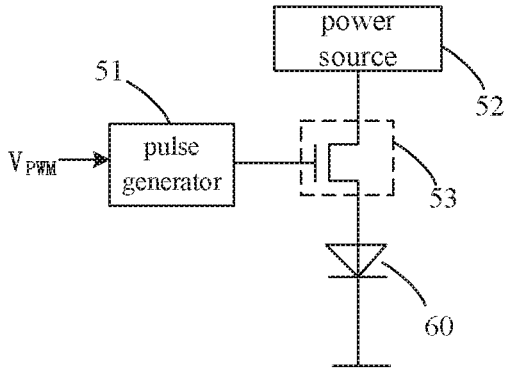
FIG. 3 is a schematic structural diagram of a light source driving circuit of a light source driving device according to an embodiment of the present disclosure.

In some embodiments, as shown in FIG. 3, the light source driving circuit includes a pulse generator 51, a power source 52, and a switch element 53. The pulse generator 51 is coupled to the control circuit and configured to generate a pulse modulation signal according to the control signal output by the control circuit, and a duty cycle of the pulse modulation signal is positively correlated with the magnitude of the control signal. The power source 52 is configured to supply a current to a light-emitting element 60 of the light source. The switch element 53 is coupled to the pulse generator 51, the power source 52, and the light-emitting element 60, and is configured to control connection and disconnection between the power source 52 and the light-emitting element 60 according to the pulse modulation signal to control an average current of the light-emitting element.

Figure 4:
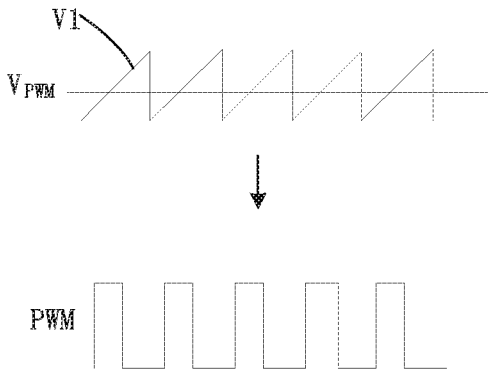
FIG. 4 is a schematic diagram illustrating principle of obtaining a pulse modulation signal from a sawtooth wave signal V1 and a control signal according to an embodiment of the present disclosure.

In some embodiments, the switch element 53 is configured to be turned on upon receipt of a high level signal and be turned off upon receipt of a low level signal. The pulse generator 51 may include a voltage comparison sub-circuit and an initial sawtooth wave signal generation sub-circuit, the initial sawtooth wave signal generation sub-circuit supplies an initial sawtooth wave signal V1 to the second input terminal of the voltage comparison sub-circuit, and the control signal $V_{PWM}$ is provided to the first input terminal of the voltage comparison sub-circuit. The voltage comparison sub-circuit is configured to output a high level signal when the voltage of its first input terminal is higher than the voltage of its second input terminal, and output a low level signal when the voltage of its first input terminal is lower than the voltage of its second input terminal, thereby outputting the pulse modulation signal. The duty cycle of the pulse modulation signal is positively correlated with the magnitude of the control signal. The principle of obtaining the pulse modulation signal PWM from the sawtooth wave signal V1 and the control signal $V_{PWM}$ is as shown in FIG. 4.

As still another aspect of the present disclosure, there is provided a display apparatus including a display module and the above-described light source driving device, the display module includes a display panel and a backlight, the backlight is coupled to the light source driving device, and the light source driving device is configured to adjust brightness of the backlight.

Figure 5:
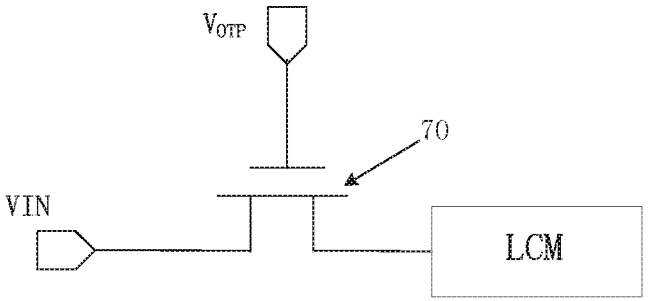
FIG. 5 is a schematic diagram illustrating principle of controlling a display module to be turned off according to an embodiment of the present disclosure.

As described above, the control circuit further includes a second comparison circuit. In this case, the display apparatus may further include a gating switch 70. As shown in FIG. 5, the gating switch 70 is coupled to the output terminal of the second comparison circuit, a power supply terminal VIN for supplying power to the display module LCM and the display module LCM, and configured to disconnect the power supply terminal from the display module LCM upon receipt of the turn-off signal from the second comparison circuit, so as to turn off the display module LCM.

The display apparatus may be any product or component having a display function, such as a mobile phone, a tablet computer, a television, a monitor, a notebook computer, a digital photo frame, a navigator, or the like.

In the light source driving device, the control circuit can generate a control signal having a magnitude negatively correlated with the temperature, and the light source driving circuit can adjust brightness of the backlight according to the control signal such that the adjusted brightness of the backlight is positively correlated with the magnitude of the control signal. Therefore, when the temperature rises, the light source driving device controls the brightness of the backlight to be lowered, so as to lower the overall temperature of the display apparatus, thereby ensuring normal operation of the display apparatus. When the temperature of the display apparatus is too high, the light source driving device can turn off the display apparatus to prevent the display apparatus from being damaged due to the high temperature.

It could be understood that the above implementations are merely exemplary implementations employed for explaining the principles of the present disclosure, but the present disclosure is not limited thereto. Various modifications and improvements can be made by those skilled in the art without departing from the spirit and essence of the present disclosure, and these modifications and improvements are also considered as falling within the protection scope of the present disclosure.

What is claimed is:

1. A control circuit comprising:

a current source circuit, configured to generate a current signal having a magnitude positively correlated with a temperature of a region where the control circuit is located;

a conversion circuit, coupled to the current source circuit and configured to convert the current signal generated by the current source circuit into a voltage signal; and a first comparison circuit, coupled to the conversion circuit and configured to output a control signal for controlling brightness of a light source according to the voltage signal received from the conversion circuit, a magnitude of the control signal being negatively correlated with the temperature of the region where the control circuit is located, and the brightness of the light source being positively correlated with the magnitude of the control signal, wherein the first comparison circuit comprises a first input terminal and a second input terminal, and at least one of the first input terminal and the second input terminal is coupled to the conversion circuit and configured to receive the voltage signal from the conversion circuit, and the first comparioson circuit is configured to output the control signal in response to a magnitude of a voltage signal input to the first input terminal being greater than a magnitude of a voltage signal input to the second input terminal, the magnitude of the control signal being negatively correlated with a different between the voltage signals input to the first input terminal and the second input terminal of the first comparison circuit, the conversion circuit comprises a first conversion sub-circuit coupled to the first input terminal of the first comparison circuit and configured to provide a first voltage signal to the first input terminal of the first comparison circuit, a magnitude of the first voltage signal being positively correlated with a magnitude of the current signal generated by the current source circuit, and the conversion circuit comprises a second conversion sub-circuit coupled to the second input terminal of the first comparison circuit and configured to provide a second voltage signal to the second input terminal of the first comparison circuit, a magnitude of the second voltage signal being negatively correlated with a magnitude of the current signal generated by the current source circuit.

2. The control circuit of claim 1, further comprising a second comparison circuit, wherein the second comparison circuit is configured to output a turn-off signal for controlling a display apparatus having the control circuit to be turned off in response to a magnitude of a voltage signal input to a first input terminal of the second comparison circuit being greater than a magnitude of a voltage signal input to a second input terminal of the second comparison circuit, and the first conversion sub-circuit is further coupled to the first input terminal of the second comparison circuit, and is configured to generate a third voltage signal having a magnitude positively correlated with the magnitude of the current signal generated by the current source circuit and output the third voltage signal to the first input terminal of the second comparison circuit; the magnitude of the third voltage signal is smaller than the magnitude of the first voltage signal.

3. The control circuit of claim 2, wherein the second conversion sub-circuit is further coupled to the second input terminal of the second comparison circuit and configured to output the second voltage signal to the second input terminal of the second comparison circuit.

4. The control circuit of claim 3, wherein the second comparison circuit comprises a voltage comparator, a non-inverting input terminal of the voltage comparator is coupled to the first input terminal of the second comparison circuit, an inverting input terminal of the voltage comparator is coupled to the second input terminal of the second comparison circuit, and an output terminal of the voltage comparator is coupled to the output terminal of the second comparison circuit.

5. The control circuit of claim 1, wherein the current source circuit comprises a current generation circuit configured to generate a bias current signal having a magnitude positively correlated with the temperature of the region where the control circuit is located;

the current source circuit further comprises a first replica circuit coupled to the current generation circuit and the first conversion sub-circuit, and configured to supply a first mirror current signal having a magnitude equal to the magnitude of the bias current signal and output the first mirror current signal to the first conversion sub-circuit; and the first conversion sub-circuit is configured to convert the first mirror current signal into the first voltage signal.

6. The control circuit of claim 5, wherein the current source circuit further comprises a second replica circuit coupled to the current generation circuit and the second conversion sub-circuit, and configured to supply a second mirror current signal having a magnitude equal to the magnitude of the bias current signal and output the second mirror current signal to the second conversion sub-circuit; and the second conversion sub-circuit is configured to convert the second mirror current signal into the second voltage signal.

7. The control circuit of claim 6, wherein the current generation circuit comprises a first triode, a second triode, a first resistor, a second resistor, a third resistor, a first P-type field effect transistor, a second P-type field effect transistor, a third P-type field effect transistor, a fourth P-type field effect transistor, a first N-type field effect transistor, a second N-type field effect transistor, a third N-type field effect transistor, and a fourth N-type field effect transistor; wherein width-to-length ratios of the first to fourth N-type field effect transistors are the same, and width-to-length ratios of the first to fourth P-type field effect transistors are the same;

a gate electrode of the first P-type field effect transistor is coupled to a second electrode of the second P-type field effect transistor, a first electrode of the first P-type field effect transistor is coupled to a power supply terminal, and a second electrode of the first P-type field effect transistor is coupled to a first electrode of the second P-type field effect transistor;

a gate electrode of the third P-type field effect transistor is coupled to the gate electrode of the first P-type field effect transistor, a first electrode of the third P-type field effect transistor is coupled to the power supply terminal, and a second electrode of the third P-type field effect transistor is coupled to a first electrode of the fourth P-type field effect transistor;

a gate electrode of the fourth P-type field effect transistor is coupled to a gate electrode of the second P-type field effect transistor and a first electrode of the third N-type field effect transistor, and a second electrode of the fourth P-type field effect transistor is coupled to a gate electrode of the third N-type field effect transistor and a gate electrode of the fourth N-type field effect transistor;

a gate electrode of the first N-type field effect transistor is coupled to a gate electrode of the second N-type field effect transistor and a first electrode of the fourth N-type field effect transistor, and a first electrode of the first N-type field effect transistor is coupled to a second electrode of the third N-type field effect transistor;

a first electrode of the second N-type field effect transistor is coupled to a second electrode of the fourth N-type field effect transistor;

a first terminal of the first resistor is coupled to a second electrode of the first N-type field effect transistor, a second terminal of the first resistor is coupled to an emitter of the first triode, an emitter of the second triode is coupled to a second electrode of the second N-type field effect transistor, and a base and a collector of the first triode and a base and a collector of the second triode are all coupled to a low level signal terminal;

a first terminal of the second resistor is coupled to the second electrode of the second P-type field effect transistor, and a second terminal of the second resistor is coupled to the first electrode of the third N-type field effect transistor; and a first terminal of the third resistor is coupled to the second electrode of the fourth P-type field effect transistor, and a second terminal of the third resistor is coupled to the first electrode of the fourth N-type field effect transistor.

8. The control circuit of claim 7, wherein the first replica circuit comprises a fifth P-type field effect transistor, a gate electrode of the fifth P-type field effect transistor is coupled to the gate electrode of the first P-type field effect transistor, a first electrode of the fifth P-type field effect transistor is coupled to the power supply terminal, and a second electrode of the fifth P-type field effect transistor is coupled to the first conversion sub-circuit; and a width-to-length ratio of the fifth P-type field effect transistor is equal to the width-to-length ratio of the first P-type field effect transistor.

9. The control circuit of claim 8, wherein the second replica circuit comprises a sixth P-type field effect transistor, a gate electrode of the sixth P-type field effect transistor is coupled to the gate electrode of the first P-type field effect transistor, a first electrode of the sixth P-type field effect transistor is coupled to the power supply terminal, and a second electrode of the sixth P-type field effect transistor is coupled to the second conversion sub-circuit; and a width-to-length ratio of the sixth P-type field effect transistor is equal to the width-to-length ratio of the first P-type field effect transistor.

10. The control circuit of claim 9, wherein the first comparison circuit comprises:

a transconductance amplifier having a non-inverting input terminal coupled to the first input terminal of the first comparison circuit, an inverting input terminal coupled to the second input terminal of the first comparison circuit, and an output terminal coupled to an output terminal of the first comparison circuit;

a sixth resistor having a first terminal coupled to the output terminal of the first comparison circuit and a second terminal coupled to the low level signal terminal; and a seventh resistor having a first terminal coupled to the power supply terminal, and a second terminal coupled to the output terminal of the first comparison circuit.

11. The control circuit of claim 10, wherein the first conversion sub-circuit comprises a resistor branch comprising at least one resistor, a first terminal of the resistor branch is coupled to the second electrode of the fifth P-type field effect transistor, a second terminal of the resistor branch is coupled to the low level signal terminal, and the first input terminal of the first comparison circuit is coupled to the first terminal of the resistor branch.

12. The control circuit of claim 10, wherein the second conversion sub-circuit comprises a third triode, a base and a collector of the third triode are coupled to the low level signal terminal, and an emitter of the third triode is coupled to the second input terminal of the first comparison circuit and the second electrode of the sixth P-type field effect transistor.

13. The control circuit of claim 12, wherein the first conversion sub-circuit comprises a fourth resistor and a fifth resistor, a first terminal of the fourth resistor is coupled to a first terminal of the fifth resistor, a second terminal of the fourth resistor is coupled to the low level signal terminal, and a second terminal of the fifth resistor is coupled to the second electrode of the fifth P-type field effect transistor; and the first input terminal of the second comparison circuit is coupled to the first terminal of the fourth resistor, and the second input terminal of the second comparison circuit is coupled to the emitter of the third triode.

14. A light source driving device, comprising the control circuit of claim 1 and a light source driving circuit coupled to the control circuit, wherein the light source driving circuit is configured to adjust the brightness of the light source according to the control signal output by the control circuit such that the adjusted brightness of the light source is positively correlated with the magnitude of the control signal.

15. The light source driving device of claim 14, wherein the light source driving circuit comprises:

a pulse generator coupled to the control circuit and configured to generate a pulse modulation signal according to the control signal output by the control circuit, a duty cycle of the pulse modulation signal being positively correlated with the magnitude of the control signal;

a power source configured to provide a current to a light-emitting element of the light source; and a switch element coupled to the pulse generator, the power source, and the light-emitting element, and configured to control connection and disconnection between the power source and the light-emitting element according to the pulse modulation signal from the pulse generator to control an average current of the light-emitting element.

16. A display apparatus, comprising a display module and the light source driving device of claim 14, wherein the display module comprises a backlight coupled to the light source driving device, and the light source driving device is configured to adjust brightness of the backlight.

17. The display apparatus of claim 16, further comprising a gating switch, wherein the control circuit in the light source driving device further comprises a second comparison circuit configured to output a turn-off signal in response to a magnitude of a voltage signal input to a first input terminal of the second comparison circuit being greater than a magnitude of a voltage signal input to a second input terminal of the second comparison circuit, the gating switch is coupled between the display module and a power supply terminal for supplying power to the display module, a control terminal of the gating switch is coupled to the second comparison circuit of the control circuit, and the gating switch is configured to disconnect the power supply terminal from the display module upon receipt of the turn-off signal from the second comparison circuit of the control circuit.

* * * * *